US005666604A

United States Patent [19]

Nakagami et al.

[11] Patent Number: 5,666,604

[45] Date of Patent: Sep. 9, 1997

[54] IMAGE FORMING APPARATUS WITH CHARGING DEVICE HAVING PROJECTING ZIP DISCHARGE ELECTRODE AND IMPROVED PARAMETERS

[75] Inventors: Yasuhiro Nakagami; Noboru Yonekawa; Kouji Matsushita, all of Toyokawa, Japan

[73] Assignee: Minolta Co., Ltd., Osaka, Japan

[21] Appl. No.: 565,216

[22] Filed: Nov. 30, 1995

[30] Foreign Application Priority Data

Dec. 1, 1994 [JP] Japan ..... 6-298553
Dec. 19, 1994 [JP] Japan ..... 6-315220

[51] Int. Cl.[6] ..... G03G 15/02

[52] U.S. Cl. ..... 399/171; 250/324; 361/229; 399/173

[58] Field of Search ..... 355/219, 225, 355/210, 211; 250/324–326; 361/212, 213, 225, 229; 399/170, 171, 168, 173, 50, 172

[56] References Cited

U.S. PATENT DOCUMENTS 4,174,170 11/1979 Yamamoto et al. ..... 361/229 X
4,233,511 11/1980 Harada et al. ..... 250/325
4,322,156 3/1982 Kohyama ..... 399/50
4,725,731 2/1988 Lang ..... 250/326
4,725,732 2/1988 Lang et al. ..... 250/326
4,792,680 12/1988 Lang et al. ..... 250/326
4,908,513 3/1990 Masuda et al. ..... 250/325 X
5,250,992 10/1993 Tsuneeda et al. ..... 399/172
5,565,963 10/1996 Tsujita et al. ..... 355/219 X

*Primary Examiner*—S. Lee
*Attorney, Agent, or Firm*—Sidley & Austin

[57] ABSTRACT

An image forming apparatus having an electrostatic latent image carrier, and a charging device which includes an electric discharge electrode having a plurality of projection and a grid electrode located between the electric discharge electrode and the surface of the electrostatic latent image carrier. A grid electrode electric current Ig passing through the grid electrode and an image carrier electric current Ip passing through the conductive base of electrostatic latent image carrier satisfy the following relationship:

$1.5 \leqq Ig/Ip \leqq 4.$

16 Claims, 9 Drawing Sheets

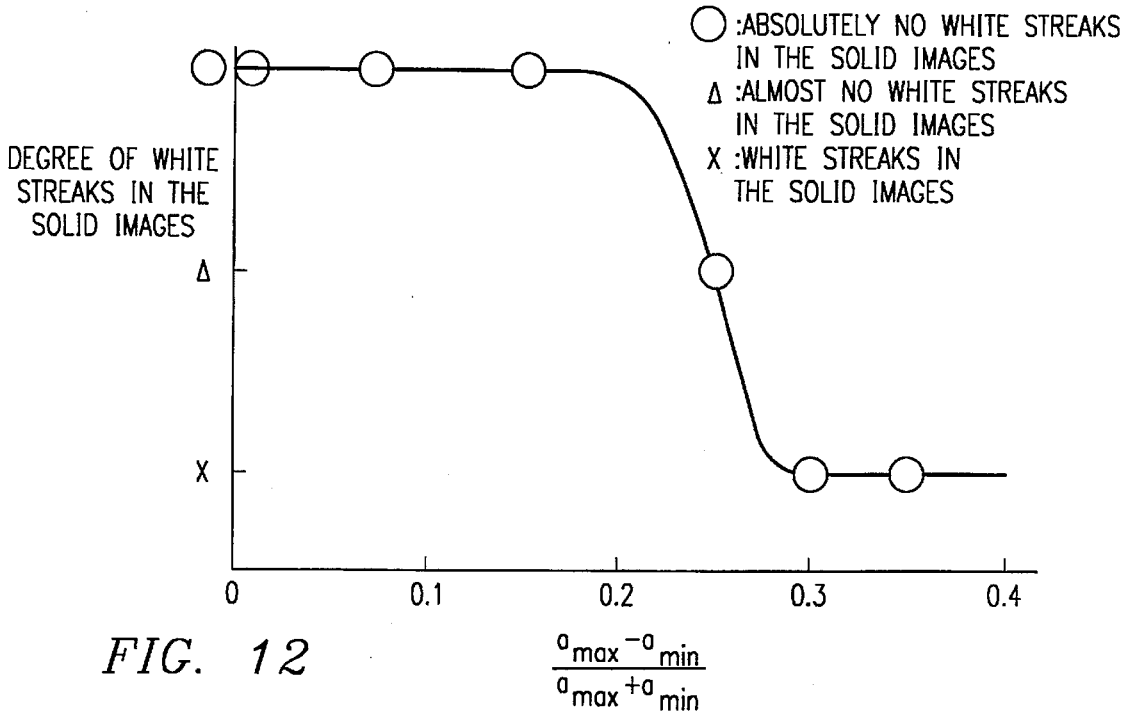
FIG. 12
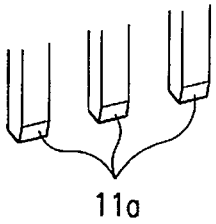
FIG. 13a
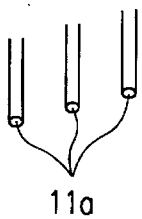
FIG. 13b
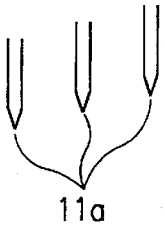
FIG. 13c
FIG. 14
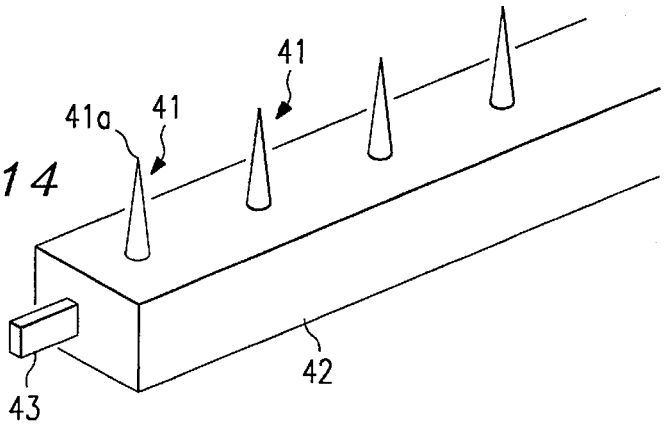

IMAGE FORMING APPARATUS WITH CHARGING DEVICE HAVING PROJECTING ZIP DISCHARGE ELECTRODE AND IMPROVED PARAMETERS

BACKGROUND OF THE INVENTION

1. Field of the Invention

The present invention relates to an electrostatic type image forming apparatus using a charging device for forming electrostatic latent images on a latent image-bearing meter such as used in electrophotographic copiers, electrophotographic printers, electrophotographic facsimiles and the like.

2. Description of the Related Art

In the field of charging devices used with electrostatic image forming apparatus, there are well-known techniques for using projection electrodes for the purpose of reducing the amount of ozone generated and improving charging efficiency.

Charging devices using projection electrodes discharge from the tip of the projection electrode. Thus, the discharge concentrates in a direction facing the tip of the projection electrode, and, therefore, the area near the tip of the projection electrode is more strongly charged relative to other areas. When a projection electrode is used, therefore, the charge state differs depending on the location, so as to cause so-called nonuniform charging. When nonuniform charging occurs, image defects occur such as irregular image density and the like.

The ozone generated during discharge by the charger causes deterioration of the charge-receiving member such as a photosensitive member and the like, and as a result causes image defects. When a projection electrode is used, the amount of ozone generated is slight compared to the amount generated when a wire electrode is used, and better images can be formed when less ozone is generated.

The generation of nitrous oxides (NOx) is affected by the discharge from the tip of the projection electrode, and nitrous oxides may adhere to said tip of the projection electrode. When NOx adheres to the tip of a projection electrode, the edges of the latent image become dim and blurred, and the image may be erased, resulting in so-called image drift. Furthermore, when the tip of the projection electrode becomes corroded by the nitric acid produced by the NOx, image defects result due to nonuniform charging as a result of inadequate discharge.

SUMMARY OF THE INVENTION

An object of the present invention is to provide an electrostatic image forming apparatus capable of accomplishing excellent image formation.

Another object of the present invention is to provide an electrostatic image forming apparatus having a charger capable of stable uniform charging.

A further object of the present invention is to provide an electrostatic image forming apparatus having a compact charger which has high charging efficiency and produces only small quantities of ozone and nitrous oxides.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 12 shows the relationship between white streak generation and the aperture efficiency of the charger of FIG. 11;

FIGS. 13(*a*)–13(*c*) are partial perspective views showing another example of the leading part of an electrode of the charger;

FIG. 14 is a partial perspective view showing another example of the discharge electrode of the charger;

DESCRIPTION OF THE PREFERRED EMBODIMENTS

The preferred embodiments of the charger of the present invention are described hereinafter with reference to the accompanying drawings.

The inventors of the present invention focused on inventing a charger provided with a corona discharging projection electrode which would allow stable uniform charging, allow precision control of the photosensitive member surface potential even after long-term use, and reduce the generation of ozone and NOx which cause image drift. Specifically, the inventors determined desirable conditions for various elements (hereinafter referred to as "parameters") comprising the corona discharger using a scorotron discharge-type corona discharger, that is, desirable settings for said parameters were determined experimentally by changing various setting conditions for the discharge electrode, grid electrode, stabilizer plate and the like.

Figure 1:
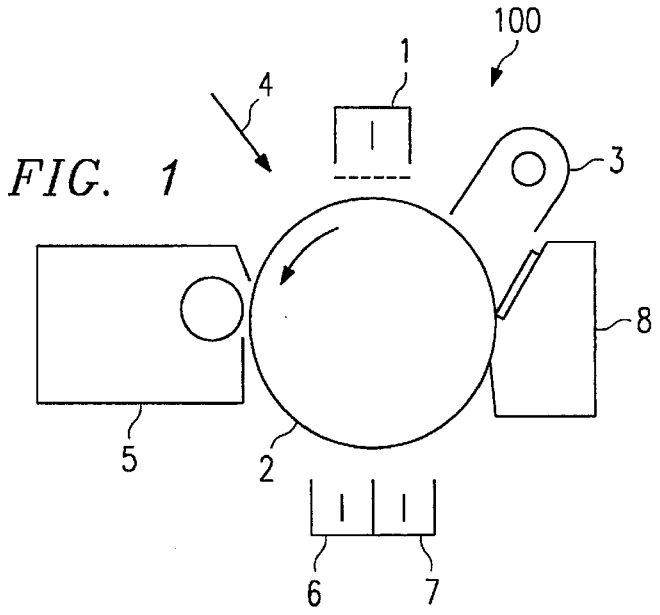
FIG. 1 is a simplified sectional view showing the essential portion of the image forming section of an electrophotographic image forming apparatus of the present invention.

The experiments described below were performed using the electrophotographic copier 100 shown in FIG. 1. In the charger 1 used as the charging device of the aforesaid electrophotographic copier 100, image formation was accomplished while variously changing the aforesaid parameters to investigate parameter settings which maintained stable uniform chargeability and suppressed NOx generation. The investigated parameter settings were settings which allowed stable uniform charging characteristics to be maintained. The investigation determined the conditions which suppress NOx generation and conditions which maintain minimal surface potential difference ΔVO between the surface potential VO when the photosensitive member is initially used and the surface potential VO' after long-term use. The reason for determining conditions which maintain minimal surface potential difference ΔVO was to avoid reduction of image density because image density is reduced when the surface potential difference ΔVO becomes large.

The construction and image forming operation of the electrophotographic copier 100 used in the experiments are described below. The electrophotographic copier 100 is an example of an image forming apparatus provided with a corona discharger adaptation of the present invention. FIG. 1 is a section view showing the essential parts of the image forming section of the electrophotographic copier 100.

The image forming section of electrophotographic copier 100 comprises a photosensitive member 2 which rotates in the direction indicated by the arrow, and arranged around the periphery of said photosensitive member 2 are a charger 1, an eraser lamp 3, an optical unit not shown in the drawing, a developing device 5, a transfer charger 6, a separation charger 7, and a cleaner 8. The photosensitive member 2 is a negative charge-type OPC photosensitive member having a diameter of 100 mm and comprising, an aluminum substrate over which is sequentially superimposed a charge-generating layer and a charge-transporting layer comprising polycarbonate resin and hydrazone compound.

The photosensitive member 2 is discharged by the eraser lamp 3, and thereafter uniformly charged by the charger 1. The charged surface of the photosensitive member 2 is subjected to optical exposure by image light 4 emitted from an optical unit not shown in the drawing, so as to form an electrostatic latent image on the photosensitive member 2. Thereafter, the latent image is developed by toner accommodated in the developing device 5 so as to form a toner image. The toner image developed by the developing device 5 is then transferred from the photosensitive member 2 onto a transfer member not shown in the drawing. The transfer member bearing the transferred toner image is separated from the photosensitive member 2 by weakening the electrostatic adhesion force via the AC output of the separation charger 7. Subsequently, the residual toner remaining on the surface of the photosensitive member 2 is collected by the cleaning device 8. The transfer member is transported to a fixing device not shown in the drawing where the toner image is fixed thereon, and said transfer member is ejected from the apparatus via a discharge mechanism which is not shown.

Figure 2:
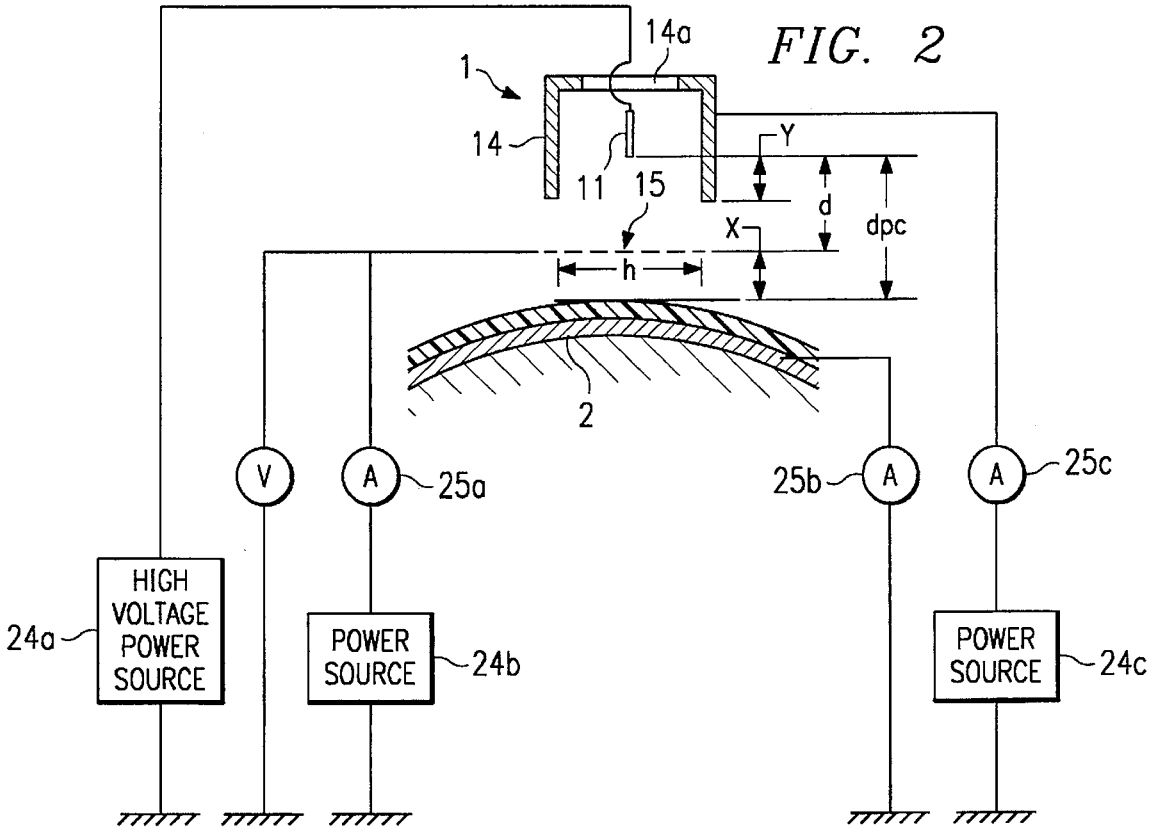
FIG. 2 is a schematic view showing the arrangement of the charger and the photosensitive member in the electrophotographic image forming apparatus of FIG. 1.
Figure 3:
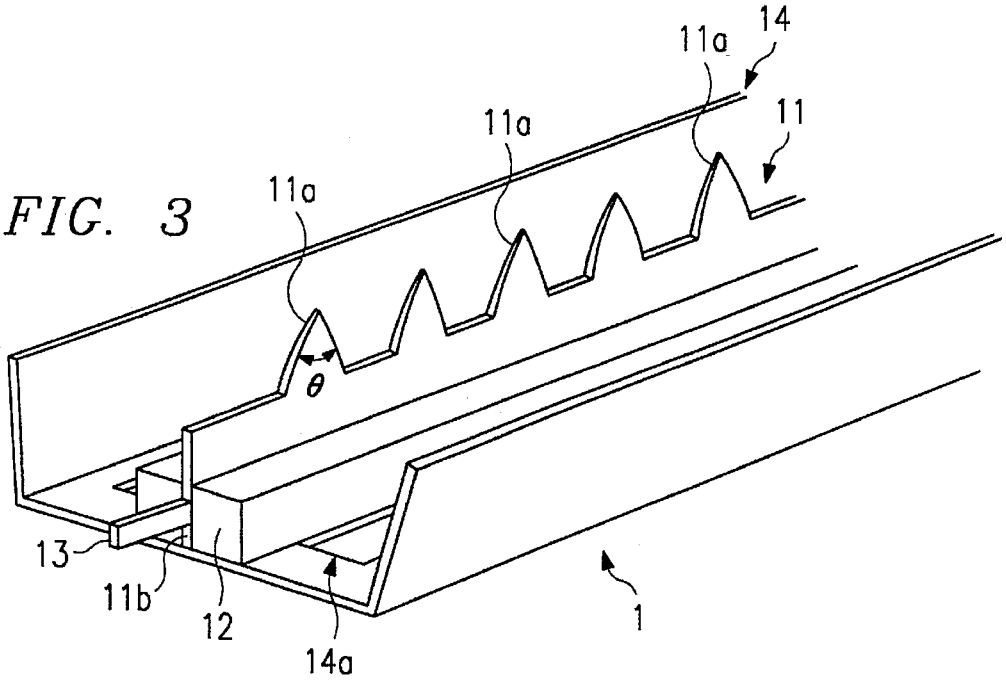
FIG. 3 is a perspective view showing a part of the charger of FIG. 2.
Figure 4:
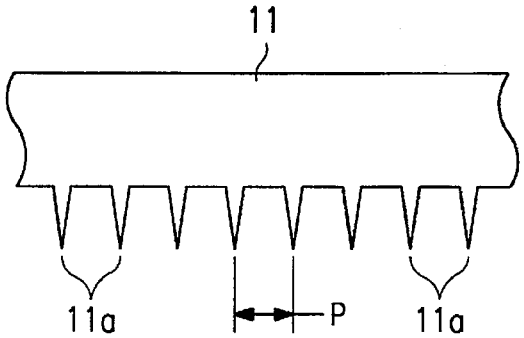
FIG. 4 is a side view of a discharge electrode provided in the charger of FIG. 2.
Figure 5:
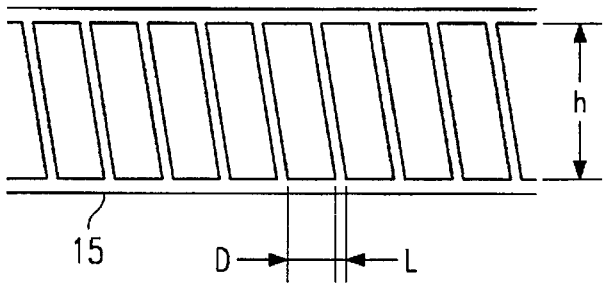
FIG. 5 is an elevational view of a grid electrode provided in the charger of FIG. 2.

FIG. 2 is a schematic view showing the arrangement of the photosensitive member 2 and the charger 1 of the present invention. FIG. 3 is a perspective view showing a part of the charger 1. FIG. 4 is a side view showing a discharge electrode 11 provided in the charger 1, and FIG. 5 is an elevation view showing a grid electrode 15 provided in the charger 1.

The charger 1 mainly comprises the discharge electrode 11, a discharge electrode holder 12, a stabilizer plate 14, and the grid electrode 15.

The discharge electrode 11 is obtained by subjecting a conductive metal plate to roll-press process, or etching process, and is provided with a sawtooth like tip **11*a*. The tip 11*a* of the discharge electrode 11 is arranged at a predetermined pitch P, as shown in FIG. 4. When pitch P is small, discharge irregularities readily occur due to mutual interference of the electric field of two adjacent discharge electrode tips. When pitch P is large, discharge irregularities readily occur due to the large distance between discharge electrode tips although the amount of ozone generated is reduced. It is therefore desirable that pitch P be set in the range of 1~4 mm. A discharge electrode tip 13 is provided at the end of the discharge electrode 11. The discharge electrode tip 13 is connected to a high voltage power source 24*a*, and supplies a charging bias to the discharge electrode 11. The current of the high voltage power source 24*a* is maintained at a constant current value Vp via a constant-current controller to obtain a more stable discharge current. The voltage of the high voltage power source 24*a* may be maintained at a constant voltage via constant-voltage controller. The tooth angle θ of the tip 11*a* is preferably set at less than 30 degrees, and ideally is set at less than 15 degrees, because more ozone and NOx is generated as the tooth angle θ increases. Conversely, when the tooth angle θ is too small, processability is adversely affected and strength is reduced, such that said tooth angle θ is set at 5 degrees or greater. Although less ozone is generated the thinner the plate thickness of the discharge electrode 11**, strength is reduced in conjunction therewith, such that a thickness of less than 0.1 mm is desirable, and a thickness of less than 0.05 mm is preferable.

Oxidation of the tip **11*a* is a cause of discharge irregularities. Thus, the discharge must be stabilized by preventing oxidation and improving durability of the electrode. The durability improvement can be accomplished if corrosion resistance and heat resistance are improved. Accordingly, at least the conductive member forming the tip 11*a* of the discharge electrode 11 may be formed of an alloy containing chrome and nickel in iron. When molybdenum is included in the alloy, corrosion resistance and heat resistance are improved. The alloy desirably contains 16~20% chrome, and ideally 16~18% chrome; and desirably contains 8~15% nickel, and ideally 10~14% nickel. When these components are present in larger amounts, the strength and the hardness of the discharge electrode 11 are diminished thereby hastening deterioration of the electrode, as well as increasing manufacturing costs. When molybdenum is included in an excessive amount, the resistance of the discharge electrode 11 is increased so as to cause an increased load on power source 4; thereby a molybdenum content of about 2~3% is desirable. Suitable conductive materials usable for the discharge electrode 11** additionally include conductive materials such as steel plate, copper plate and the like which have been treated for corrosion resistance with nickel plating and the like, as well as tungsten and the like.

The discharge electrode holder 12 bilaterally supports base **11*b* of the discharge electrode 11. The discharge electrode holder 12** is formed of insulated material having heat resistance, corrosion resistance, and high voltage resistance characteristics such as ceramic materials, insulating heat-resistant resins and the like.

The stabilizer plate 14 is formed of a metal plate such as stainless steel plate, copper plate, steel plate and the like bent so as to form a flat-bottomed U-shape configuration, which internally accommodates the discharge electrode 11 and the discharge electrode holder 12. The stabilizer plate 14 circumscribes three directions, the fourth unobstructed direction being the discharge direction of the discharge electrode 11. Thus, the charge generated by the discharge electrode 11 in directions other than the discharge direction is contained as an influx current by the stabilizer plate 14. Since the discharge is suppressed in all directions but the discharge direction as described above, the electric field formed by the discharge electrode 11 is stabilized. In the present embodiment, in particular, a power source 24*c* is connected. Power source 24*c* maintains a constant voltage Vsh to the stabilizer plate 14. The stabilizer plate 14 may be installed via resistors. The surface of the stabilizer plate 14 opposite the tips 11*a* of the discharge electrode 11 is provided with an aperture 14*a*. Ozone and NOx generated by the discharge are expelled through aperture 14*a* via a fan not shown in the drawing so as to avoid their residing between the tips 11*a* and the photosensitive member 2. The aperture 14*a* may be omitted if construction is such that it is difficult for ozone and NOx to remain between the tips 11*a* and the photosensitive member 2.

As the distance Y from the tips 11*a* of the discharge electrode 11 to the bottom edge of the stabilizer plate 14 becomes smaller, the amount of charge increases from the tips 11*a* of the discharge electrode 11 toward the stabilizer plate 14. Thus, the charge to the photosensitive member 2 is diminished, and the predetermined photosensitive member surface potential VO cannot be obtained. In order to obtain the predetermined photosensitive member surface potential VO, the output of high voltage power source 24*a* must be increased, but when the output of the high voltage power source 24*a* is increased, ozone and NOx generation increases. Therefore, the stabilizer plate 14 must be set under conditions which consider the aforesaid tendency.

The charger 1 is arranged such that the tip 11*a* of the discharge electrode 11 confront the photosensitive member 2, and the grid electrode 15 is disposed between the discharge electrode 11 and the photosensitive member 2.

The grid electrode 15 is formed by plurality of grid wires arranged with predetermined spacing. The aperture width of the grid electrode 15 is designated h, the width of each grid wire in a direction across the discharge electrode 11 is designated L, and the space between the grid wires is designated D. The grid wire pattern is formed by etching process or pressing process or the like using stainless steel plate, copper plate, or the like having a thickness of about 0.05~2 mm. The grid electrode pore pattern is not limited to the pattern shown in FIG. 5, and some suitable patterns matching use conditions and conditions of processing costs and the like are selectable.

A power source 24*b* is connected to the grid electrode 15. The power source 24*b* maintains a constant voltage Vg to the grid electrode 15 by means of constant voltage control. A constant voltage element such as a varistor or the like may alternatively be connected to the grid electrode 15 in place of the power source 24*b*.

The relationships among the grid wire spacing D and the grid wire width L of the grid wire 15 and the pitch P of the tips 11*a* of the discharge electrode 11 preferably satisfy the conditions stipulated in the equations below.

$$P/(D+L)=n$$

(where n is an integer)

and $$N+0.9 \leqq P/(D+L) \leqq n+1.1$$

If the relationships among the grid wire spacing D and the grid wire width L of the grid wire 15 and the pitch P of the tips 11*a* of the discharge electrode 11 satisfy the conditions stipulated in the aforesaid equations, corrosion caused by nitrous oxide adhering to the tips 11*a* of the discharge electrode 11 (this phenomenon readily occurs especially under environmental conditions of high temperature and high humidity), and discharge irregularities can be suppressed even when materials such as Si and the like adhere to the tips 11*a* of the discharge electrode 11.

It is further desirable that the relationship between the distance dpc from tips 11*a* of the discharge electrode 11 to the photosensitive member 2 and the pitch P of the tips 11*a*, the grid wire spacing D and the grid wire width L of the grid electrode 15 satisfies the following conditions.

$$2 \leqq dpc(D+L)/P \leqq 8$$

If the value of dpc(D+L)/P is set within the aforesaid range, discharge irregularity is minimized. Specifically, discharge irregularities readily occur when the distance dpc from the tips 11*a* of the discharge electrode 11 to the photosensitive member 2 becomes too great. Conversely, discharge irregularities readily occur when the distance dpc is too small because the discharge from the tip 11*a* of the discharge electrode 11 slips between the grid wires of the grid electrode 15 thereby increasing the charge reaching the photosensitive member 2.

When the grid wire width L is too small, the mechanical strength of the grid electrode 15 is weakened. Conversely, when the grid wire width L is too large, the discharge from the tips 11*a* of the discharge electrode 11 causes an influx current Ig to increase to the grid electrode 15. When the influx current Ig becomes too large, said influx current slips between the grid wires and reduces the charge reaching the photosensitive member 2, thereby reducing the surface potential of the photosensitive member 2 compared to the potential of the grid electrode 15 so as to cause charge irregularities. It is therefore desirable that the grid wire width in the range of 0.05~0.2 mm.

When the distance D between the grid wires is too small, the influx current Ig increases from the tips 11*a* of the discharge electrode 11 to the grid electrode 15. Under such conditions, it becomes difficult for the discharge from the discharge electrode 11 at the start of discharge to pass between the grid wires and reach the photosensitive member 2, such that the potential difference of the grid voltage Vg and the photosensitive member surface potential VO must be increased to obtain a predetermined photosensitive member surface potential VO. On the other hand, when the distance D between the grid wires is too large, discharge irregularities readily occur when the potential difference of the grid voltage Vg and the photosensitive member surface potential VO decreases after discharge starts, due to the increased charge slipping between the grid wires and reaching the photosensitive member 2. Furthermore, the grid voltage Vg must be lower than the photosensitive member surface potential VO to obtain a predetermined photosensitive member surface potential VO. Thus, it is desirable that the distance D between the grid wires be set in the range of 0.5~1.8 mm.

When the distance X between the grid electrode 15 and the photosensitive member 2 is too small, discharge irregularities readily occur because the discharge from the discharge electrode 11 slips between the grid wires so as to increase the amount of charge reaching photosensitive member 2.

When the discharge electrode 11 is discharging, the grid electrode 15 moves from the photosensitive member 2 and approaches the discharge electrode 11 by an electrostatic force, and conversely, when discharge electrode 11 is not discharging, the grid electrode 15 moves from discharge electrode 11 and approaches the photosensitive member 2 by an electrostatic force. Thus, the grid electrode 15 oscillates by means of the aforesaid forces. When the distance X separating the grid electrode 15 and the photosensitive member 2 is too small, the grid electrode 15 comes into contact with the surface of the photosensitive member 2 via the aforesaid oscillation of the grid electrode 15 due to the action of the aforesaid electrostatic force so as to damage the surface of the photosensitive member 2. Furthermore, when the distance X separating the grid electrode 15 and the photosensitive member 2 is small, the potential difference of the grid voltage Vg and the photosensitive member surface potential. VO is reduced, allowing a predetermined photosensitive member surface potential VO to be obtained by controlling the grid voltage Vg. On the other hand, when the distance X separating the grid electrode 15 and the photosensitive member 2 is too large, the discharge from the discharge electrode 11 slips between the grid wires so as to reduce the charge reaching the photosensitive member 2. In this case, the grid voltage Vg must be greater than the photosensitive member surface potential VO to obtain a predetermined photosensitive member surface potential VO, such that the potential difference of the grid voltage Vg and the photosensitive member surface potential VO must be increased. Therefore, the distance between the grid electrode 15 and the photosensitive member 2 is suitably set within a desirable range of 0.5~3 mm, and ideally 0.8~1.8 mm.

The inventors of the present invention performed various experiments relating to the various parameters of the charger, and discovered that the ratio of the current of the photosensitive member charging current Ip and the grid electrode current Ig influences the amount of NOx generated and the amount which adheres to the photosensitive member. Therefore, the present inventors investigated optimum setting conditions for the photosensitive member charging current Ip and the grid electrode current Ig to suppress NOx generation and prevent image drift and charge irregularities. Specifically, the copier 100 was used which was provided with the charger 1 and various parameters set as described in a setting condition 1 below, and image formation was performed by varying the photosensitive member charging current Ip and the grid electrode current Ig to confirm the occurrence of image drift and discharge irregularities.

The setting condition 1 is based on the tendencies of the various parameters of the charger as previously described. These settings are conditions which prevent image drift and discharge irregularities and are shown below.

| Condition 1 | | |
|---|---|---|
| Pitch of tips 11a of electrode 11 | P | :2 mm |
| Thickness of discharge electrode 11 | t | :0.05 mm |
| Tooth angle of tips 11a | θ | :10° |
| Grid electrode 15 wire width | L | :0.1 mm |
| Grid electrode 15 distance between wires | D | :0.9 mm |
| Distance between tips 11a and photosensitive member 2 | dpc | :10 mm |

-continued

| Condition 1 | | |
|---|---|---|
| | dpc(D + L)/P = 5 | |
| Distance between grid electrode 15 and photosensitive member 2 | X | :1 mm |
| Distance between grid electrode 15 and stabilizer plate 14 | Y | :2 mm |

In the condition 1 experiment below, the optimum conditions were determined for the photosensitive member charging current Ip and the grid electrode current Ig for suppressing image drift and discharge irregularities.

As shown in FIG. 2, the grid electrode 15, the substrate of the photosensitive member 2, and the stabilizer plate 14 were respectively connected to ammeters 25*a*~25*c*. The photosensitive member 2 was charged under a plurality of conditions having different current values displayed by these ammeters 25*a*~25*c*, and images were formed on the surface of the photosensitive member 2. The formed images were evaluated for image drift and discharge irregularities.

Specifically, the value of the photosensitive member charging current Ip displayed by the ammeter 25*b* was set variously at 100 μA, 150 μA, 200 μA, and 250 μA, and the value of the grid electrode voltage Ig was changed with respect to the value of Ip by changing the current of the discharge electrode 11 or the peripheral speed of the photosensitive member 2. During the experiments, various combinations of the current of the discharge electrode 11 and the peripheral speed of the photosensitive member 2 were used to obtain experimental values for each current value (Ip, Ig) via the ammeters 25*a*~25*c*. Furthermore, the current of the discharge electrode 11 was changed by changing the output of the high voltage power source 24*a*.

Confirmation of the occurrence of image drift was accomplished by supplying a voltage of −800 volts to the discharge electrode 11, and repeating 100,000 image formations on the surface of the photosensitive member 2, and subsequently allowing the apparatus to stand idle for 12 hours under environmental conditions of high temperature and high humidity, after which image formation was again performed. In this experiment, the developing device 5 was replaced by a surface potentiometer (not shown in the illustrations) before image formation and only a latent image was formed on the surface of the photosensitive member 2, and the surface potential VO of the photosensitive member 2 was measured, to determine the value of VO−Vg (i.e., a value expressing the difference in surface potential of the photosensitive member 2 with respect to the controlled voltage of the grid electrode 15, said value preferably approaching zero) and the value of ΔVO=VO−VO' (i.e., a value expressing the potential difference between the surface potential VO of the photosensitive member 2 at the start and the surface potential VO' after long-term use). During image formation, the developing device 5 was again installed to develop as a toner image the latent image formed on the surface of the photosensitive member 2. Determination of the value of VO−Vg and ΔVO was accomplished to confirm whether or not satisfactory charging characteristics were maintained. That is, when the value of VO−Vg became large, control of the surface potential of the photosensitive member by the grid voltage was reduced, and when the value of ΔVO became large, image density was reduced.

Image formation under environmental conditions of high temperature and high humidity was performed in a state wherein NOx adheres to the photosensitive member 2, and image drift readily occurs due to dew condensation to the adhered NOx, so as to confirm whether or not image drift occurred.

Figure 6:
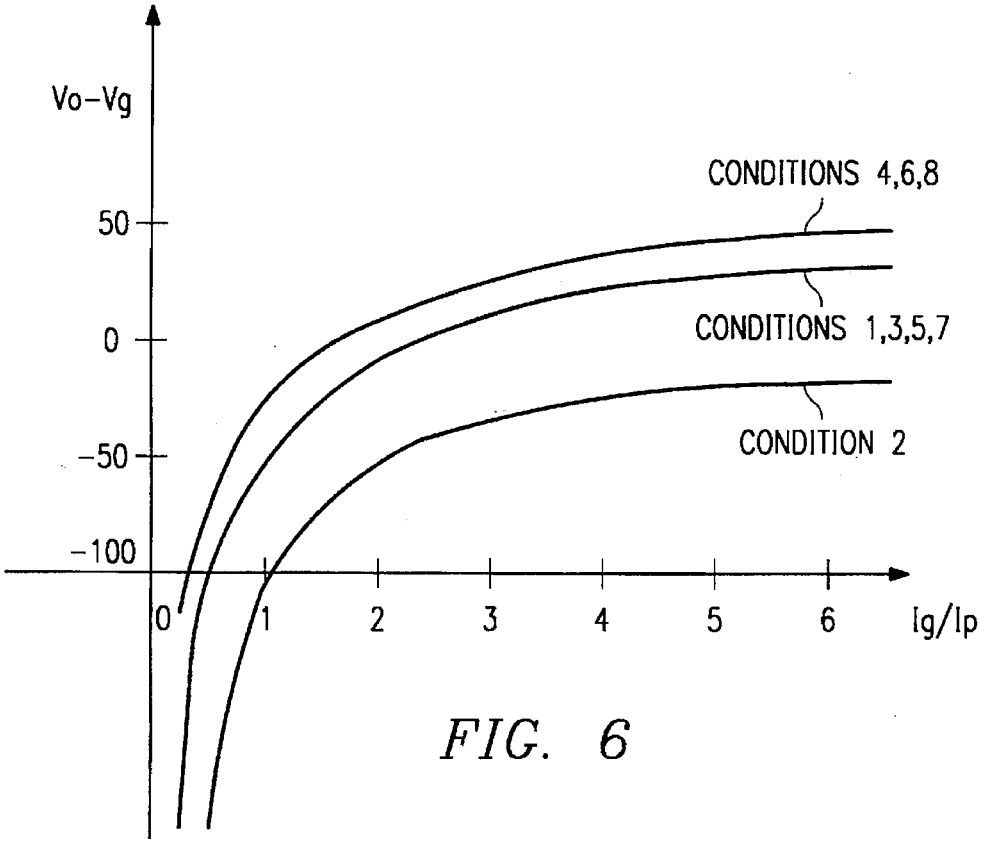
FIG. 6 is a graph showing the relationship between Ig/Ip and Vo–Vg in the charger of FIG. 2.

The results of these experiments are described below. FIG. 6 is a graph showing the relationship between Ig/Ip and VO–Vg when the copying speed is 460mm/sec. This graph shows the values Ig/Ip on the horizontal axis, and the values VO–Vg on the vertical axis. As can be readily understood from the graph of FIG. 6, the value of VO–Vg rapidly increases in the vicinity of Ig/Ip=0.5. Therefore, it is difficult to achieve precise control of the surface potential VO of the photosensitive member 2 via the grid potential Vg in the aforesaid region. Furthermore, in this vicinity, discharge irregularities may be occurring or the surface potential VO may be extremely low in areas. As a result, areas of reduced image density appear as streaks in the image. Therefore, the value of Ip/Ig must be set at a minimum of 1.0≦Ig/Ip.

Table 1 shows the results of image drift evaluation at setting condition 1 when the value of Ip/Ig is such that 1.0≦Ig/Ip.

TABLE 1

| Ig/Ip | ΔVO | Image Drift |
|---|---|---|
| 1 | About 45 V | None |
| 1.5 | About 20 V | None |
| 3 | About 20 V | None |
| 4 | About 20 V | None |
| 10 | About 35 V | None |
| 13 | About 40 V | Exist |

As shown in Table 1, image drift occurs when Ig/Ip=13. This image drift occurs because the discharge from the discharge electrode 11 is large and increases NOx generation. As previously described, when a significant amount of NOx adheres to the surface of the photosensitive member 2, which under environmental conditions of high temperature and high humidity makes dew condensation with the surface of the photosensitive member 2 so as to reduce the electrical resistance of said surface of the photosensitive member 2, whereby the charge of the unexposed areas moves to the exposed areas so as to erase the formed latent image causing blurring of the image edges and image drift. On the other hand, image drift did not occur when 1≦Ig/Ip≦10.

When Ig/Ip=10 and Ig/Ip=13, the potential difference ΔVO was larger compared to when Ig/Ip=3. The reason for this difference is believed to believed to be that most of the charge slips between the grid wires and reaches the photosensitive member 2. That is, control of the scorotron is adversely affected, such that operation is identical to that when the scorotron charge is only the charge which slips past the grid wires.

If ΔVO is about 20 V, however, there is extremely slight variation in image density compared to when the photosensitive member 2 is first used, and there is no problem in terms of image quality. As shown in Table 1, when the relationship between the grid current Ig and the photosensitive member charging current Ip is such that 1.5≦Ig/Ip≦4, ΔVO can be controlled at less than about 20 V.

In the precision control of the photosensitive member charging potential VO by grid potential Vg, it is desirable that the value of VO–Vg is small. As can be clearly understood from FIG. 6, if 1.5≦Ig/Ip≦4, VO–Vg is maintained in a range of about −20~+20 V. This value is a sufficiently small value to allow precision control of the surface potential VO of the photosensitive member 2.

Therefore, the aforesaid results indicate that it is desirable to set the grid current Ig and the photosensitive member charging current Ip so that Ig/Ip is included in the range 1.5≦Ig/Ip≦4.

When Ig/Ip=1.5, VO–Vg is large, but the photosensitive member potential VO can be precisely controlled by the grid potential Vg so as to allow correspondence even when image density is reduced, and therefore presents no particular problem.

Experiments were performed using setting conditions 2~8 described below. Conclusions derived from the above-mentioned experimental results, i.e., the optimum conditions of the grid potential Vg and the photosensitive member charging current Ip are 1.5≦Ig/Ip≦4, were investigated to determine whether or not identical results would be obtained under different conditions. Specifically, we investigated undesirable setting conditions, e.g., conditions readily producing image drift, conditions readily producing discharge irregularities, and conditions readily causing a large difference ΔVO between the surface potential VO when the photosensitive member 2 is first used and surface potential VO' after long-term use. The apparatus and methods used in the experiments are identical to those described with respect to setting the condition 1.

| Condition 2 | | |
|---|---|---|
| Pitch of tips 11a of electrode 11 | P | :2 mm |
| Thickness of discharge electrode 11 | t | :0.1 mm |
| Tooth angle of tips 11a | θ | :30° |
| Grid electrode 15 wire width | L | :0.1 mm |
| Grid electrode 15 distance between wires | D | :0.9 mm |
| Distance between tip 11a and photosensitive member 2 | dpc | :14 mm |
| | dpc(D + L)/P = 7 | |
| Distance between grid electrode 15 and photosensitive member 2 | X | :1 mm |
| Distance between grid electrode 15 and stabilizer plate 14 | Y | :0.5 mm |

This condition 2 sets a larger tooth angle of the tips 11*a* of the discharge electrode 11, and a thicker discharge electrode 11 compared to setting condition 1, and sets a lesser distance between the grid electrode 15 and the stabilizer plate 14 than in the condition 1.

| Condition 3 | | |
|---|---|---|
| Pitch of tips 11a of electrode 11 | P | :2 mm |
| Thickness of discharge electrode 11 | t | :0.1 mm |
| Tooth angle of tips 11a | θ | :30° |
| Grid electrode 15 wire width | L | :0.1 mm |
| Grid electrode 15 distance between wires | D | :0.9 mm |
| Distance between tips 11a and photosensitive member 2 | dpc | :7 mm |
| | dpc(D + L)/P = 4 | |
| Distance between grid electrode 15 and photosensitive member 2 | X | :1 mm |
| Distance between grid electrode 15 and stabilizer plate 14 | Y | :0.5 mm |

This condition 3 sets the distance between the photosensitive member 2 and the tips 11*a* of the discharge electrode 11 at a lesser setting than in the condition 2. Thus, the condition 3 more readily allows ozone and NOx adhesion on the photosensitive member 2 than does the condition 2.

| Condition 4 | | |
|---|---|---|
| Pitch of tips 11a of electrode 11 | P | :4 mm |
| Thickness of discharge electrode 11 | t | :0.1 mm |

-continued

| Condition 4 | | |
|---|---|---|
| Tooth angle of tips 11a | θ | :10 |
| Grid electrode 15 wire width | L | :0.2 mm |
| Grid electrode 15 distance between wires | D | :1.6 mm |
| Distance between tips 11a and photosensitive member 2 | dpc | :13 mm |
| | dpc(D + L)/P = 8 | |
| Distance between grid electrode 15 and photosensitive member 2 | X | :1 mm |
| Distance between grid electrode 15 and stabilizer plate 14 | Y | :8 mm |

This condition 4 sets the pitch of the tips 11*a* of the discharge electrode 11, the thickness of the discharge electrode 11, the grid wire width of the grid electrode 15, the distance between the grid wires of the grid electrode 15, the distance between the photosensitive member 2 and the tips 11*a* of the discharge electrode 11, and the distance between the grid electrode 15 and the stabilizer plate 14 at greater values than does the condition 1.

| Condition 5 | | |
|---|---|---|
| Pitch of tips 11a of electrode 11 | P | :4 mm |
| Thickness of discharge electrode 11 | t | :0.1 mm |
| Tooth angle of tips 11a | θ | :10° |
| Grid electrode 15 wire width | L | :0.1 mm |
| Grid electrode 15 distance between wires | D | :0.9 mm |
| Distance between tips 11a and photosensitive member 2 | dpc | :8 mm |
| | dpc(D + L)/P = 2 | |
| Distance between grid electrode 15 and photosensitive member 2 | X | :1 mm |
| Distance between grid electrode 15 and stabilizer plate 14 | Y | :6 mm |

This condition 5 sets the pitch of the tips 11*a* of the discharge electrode 11, the thickness of the discharge electrode 11, and the distance between the grid electrode 15 and the stabilizer plate 14 at values greater than those of the condition 1, and sets the distance between the photosensitive member 2 and the tips 11*a* of the discharge electrode 11 at a value smaller than in the condition 1.

| Condition 6 | | |
|---|---|---|
| Pitch of tips 11a of electrode 11 | P | :1 mm |
| Thickness of discharge electrode 11 | t | :0.1 mm |
| Tooth angle of tips 11a | θ | :10° |
| Grid electrode 15 wire width | L | :0.2 mm |
| Grid electrode 15 distance between wires | D | :1.6 mm |
| Distance between tips 11a and photosensitive member 2 | dpc | :7 mm |
| | dpc(D + L)/P = 5.4 | |
| Distance between grid electrode 15 and photosensitive member 2 | X | :1 mm |
| Distance between grid electrode 15 and stabilizer plate 14 | Y | :4 mm |

This condition 6 sets the thickness of the discharge electrode 11, the grid wire width of the grid electrode 15, the distance between the grid wires of the grid electrode 15, and the distance between the grid electrode 15 and the stabilizer plate 14 at values greater than those of the condition 1, and sets the pitch of the tips 11*a* of the discharge electrode 11, and the distance between the photosensitive member and the tips 11*a* of the discharge electrode 11 at values smaller than those of the condition 1.

| Condition 7 | | |
|---|---|---|
| Pitch of tips 11a of electrode 11 | P | :2 mm |
| Thickness of discharge electrode 11 | t | :0.05 mm |
| Tooth angle of tips 11a | θ | :10° |
| Grid electrode 15 wire width | L | :0.1 mm |
| Grid electrode 15 distance between wires | D | :0.5 mm |
| Distance between tips 11a and photosensitive member 2 | dpc | :12 mm |
| | dpc(D + L)/P = 3.6 | |
| Distance between grid electrode 15 and photosensitive member 2 | X | :1.8 mm |
| Distance between grid electrode 15 and stabilizer plate 14 | Y | :0.5 mm |

This condition 7 sets the distance between the photosensitive member 2 and the tips 11*a* of the discharge electrode 11, and the distance between the photosensitive member 2 and the grid electrode 15 at values greater than those of the condition 1, and sets the distance between the grid wires of the grid electrode 15, and the distance between the grid electrode 15 and the stabilizer plate 14 at values smaller than those of the condition 1.

| Condition 8 | | |
|---|---|---|
| Pitch of tips 11a of electrode 11 | P | :2 mm |
| Thickness of discharge electrode 11 | t | :0.05 mm |
| Tooth angle of tips 11a | θ | :10° |
| Grid electrode 15 wire width | L | :0.1 mm |
| Grid electrode 15 distance between wires | D | :1.6 mm |
| Distance between tips 11a and photosensitive member 2 | dpc | :10 mm |
| | dpc(D + L)/P = 8.5 | |
| Distance between grid electrode 15 and photosensitive member 2 | X | :1 mm |
| Distance between grid electrode 15 and stabilizer plate 14 | Y | :2 mm |

This condition 8 sets the distance between the grid wires of the grid electrode 15 at a value greater than that of the condition 1.

The experimental results of the conditions 2~8 described above are all identical to the experimental results of the condition 1 shown in Table 1. Thus, it was confirmed that the optimum conditions for the grid current Ig and the photosensitive member charging current Ip are $1.5 \leqq Ig/Ip \leqq 4$. In this way, ozone and NOx generation is reduced and the discharge from the projection electrode is stabilized by setting the grid current Ig and the photosensitive member charging current Ip so that $1.5 \leqq Ig/Ip \leqq 4$. As a result, after long-term use of the photosensitive member, discharge irregularities and image drift do not occur and excellent images are obtained even under environmental conditions of high temperature and high humidity after long-term use.

Since the potential difference between the grid potential and the surface potential of the photosensitive member can be minimized, the surface potential of the photosensitive member can be precisely controlled by controlling the potential applied to the grid electrode.

Even after long-term use, the surface potential can be precisely controlled because there is only slight change in the surface potential of the photosensitive member relative to the surface potential at the start of use. Furthermore, deterioration of image density after long-term use can be also minimized.

The stabilizer current Ish supplied to the stabilizer plate 14 was also considered as one of three optimum conditions in addition to the grid current Ig and the photosensitive member charging current Ip. The apparatus used in this experiment is the same as used in the previous experiments.

Figure 7:
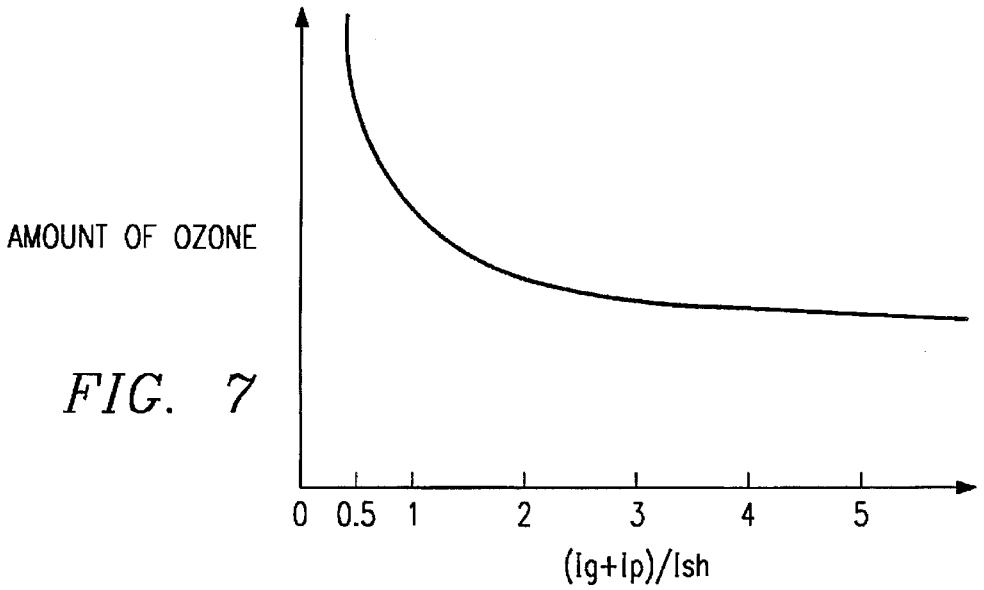
FIG. 7 is a graph showing the relationship between (Ig+Ip)/Ish and ozone concentration in the charger of FIG. 2.

FIG. 7 is a graph showing the relationship between ozone concentration and (Ig+Ip)/Ish. This graph plots the relationship of (Ig+Ip)/Ish and ozone measured density measured when the copying speed remains a constant 460 mm/sec whereas the current applied to the discharge electrode 11 and the distance between the discharge electrode 11 and the stabilizer plate 14 are varied. At this time, the value of the grid current Ig was varied relative to the value of the photosensitive member charging current Ip such that Ig/Ip= 2, 3, and 4 in order to suppress discharge irregularities and minimize VO–V.

Table 2 shows the results of image drift evaluations by repeating 100,000 image formations on the surface of the photosensitive member 2, and subsequently allowing the apparatus to stand idle for 12 hours under environmental conditions of high temperature and high humidity, after which image formation was again performed, under the aforesaid conditions.

TABLE 2

| (Ig + Ip)/Ish | ΔVO | Image Drift |
|---|---|---|
| 0.5 | About 20 V | Exist |
| 1 | About 20 V | None |
| 2 | About 20 V | None |

As shown in FIG. 7, when the relationships among the three parameters of the photosensitive member current Ip, the grid current Ig, and the stabilizer current Ish are stipulated by the expression (Ig+Ip)/Ish, and (Ig+Ip)/Ish is set at(Ig+Ip)/Ish=1, there is a 30% reduction in the amount of ozone generated compared to when (Ig+Ip)/Ish=0.5. Setting (Ig+Ip)/Ish at (Ig+Ip)/Ish=3 produces a 50% reduction in ozone generation compared to when (Ig+Ip)/Ish=0.5. Thus, the amount of zone generated can be reduced by increasing the value of (Ig+Ip)/Ish. As can be readily understood from Table 2, image drift occurs when (Ig+Ip)/Ish is set at (Ig+Ip)/Ish=0.5. Therefore, is desirable that the relationship of the three parameters of the photosensitive member current Ip, the grid current Ig, and the stabilizer current Ish be set such that $1 \leqq (Ig+Ip)/Ish$. When set thusly, excellent images can be obtained without image drift even after long-term use of the photosensitive member, i.e., even under environmental conditions of high temperature and high humidity after long-term use of the photosensitive member. Furthermore, ozone generation can be suppressed, deterioration of the photosensitive member can be avoided, and image formation can be stabilized.

The inventors of the present invention then investigated the optimum value of the grid electrode aperture width h.

Figure 8:
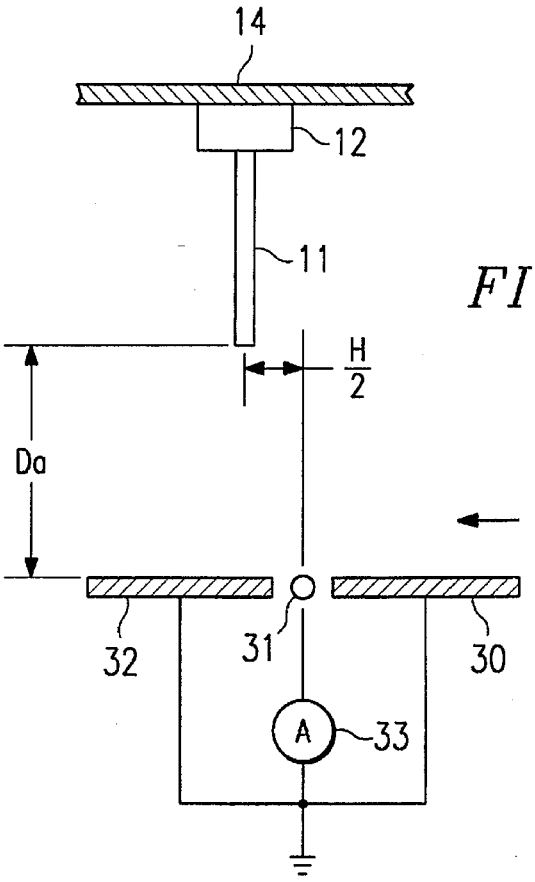
FIG. 8 is a simplified view of a current distribution measuring device.
Figure 9:
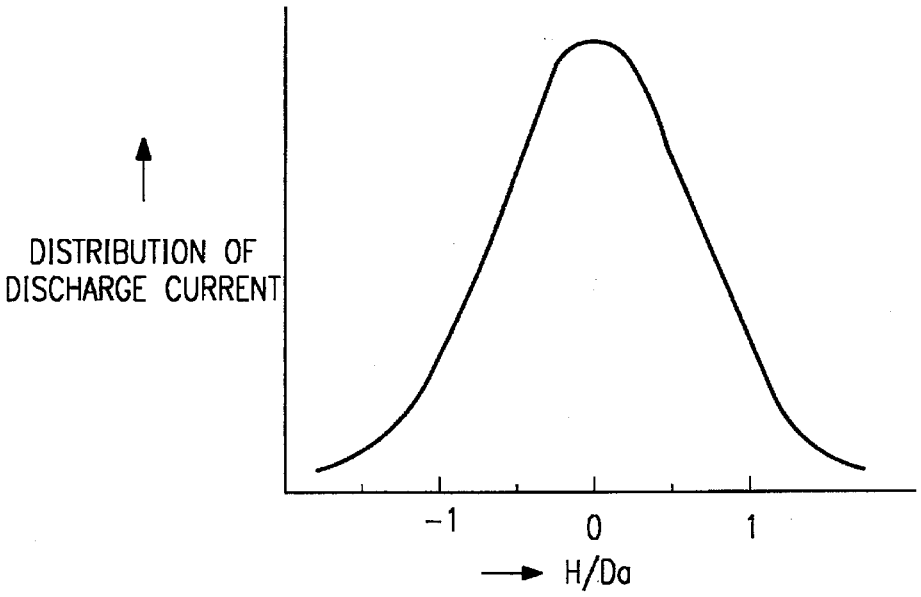
FIG. 9 shows the current distribution of a charger of the present invention.

FIG. 8 briefly shows a current distribution measuring device 30. The current distribution measuring device 30 measures discharge current distribution of the discharge electrode 11. The current distribution measuring device 30 mainly comprises a measuring electrode 31, a guard electrode 32, and an ammeter 33. The measuring electrode 31 comprises wire elements arranged parallel to the electrode array of the discharge electrode 11, which supports the influx current of the discharge current of the discharge electrode 11. The guard electrode 32 is grounded on both sides of the measuring electrode 31, and prevents influx of unnecessary current to the measuring electrode 31 by dropping the discharge current around the periphery of the discharge electrode 11 to the ground. The ammeter 33 measures the influx current of the measuring electrode 31. Therefore, the value of the discharge current at the position of the discharge electrode 11 can be measured by the ammeter 33. As the measuring electrode 31 and the guard electrode 32 are integratedly moved, the current of the measuring electrode 31 is measured by the ammeter 33 to measure the distribution of the discharge current of the discharge electrode 11. In FIG. 8, reference symbol D2 refers to the distance between the discharge point of the discharge electrode 11 and the measuring electrode 31 in a direction perpendicular to the plane containing the guard electrode 32 and the measuring electrode 31; reference symbol H/2 refers to the lateral offset distance (in a horizontal direction in the drawing) between a line in the discharge direction and a line through the measuring electrode extending parallel to the line in the discharge direction. The distribution of the discharge current at this time is shown in FIG. 9. It can be understood from FIG. 8 that equivalent portions of the total current flows between H/Da=−1 and H/Da=+1, and when H/Da is either $\leqq 1.5$ or $\leqq -1.5$, an equivalent flow does not occur. When a grid electrode is disposed medially to the member being charged and the discharge electrode, optimum charging efficiency is obtained if the grid electrode apertures in the region $1 \leqq H/Da \leqq +1$ match, because only the charge current flowing to the grid electrode apertures participates in charging.

Thus, when the distance between the grid electrode 15 and the discharge point of the tips 11*a* of the discharge electrode 11 is designated d (mm) and the width of the mesh aperture of the grid 15 is designated h (mm), the majority of the discharge current can be used for the charging function if h/d is 1 or greater. On the other hand, if h/d is less than 1.5, nearly all of the charge current is ineffective. When h is larger, there is virtually no change in the influx discharge current to the mesh aperture after the moment h/d becomes 1 or greater. Accordingly, when h/d is 1 or greater, charging efficiency is not particularly improved and the size of the charger merely is increasing. Thus, when the relationship of the values d and h are set such that $1 \leqq h/d \leqq 1.5$, charging power is increased and a compact charger can be produced.

When the value of d becomes large, impedance increases and a large scale power source must be used to increase the voltage required to obtain the same current value. Furthermore, when the value of d becomes large, the value of h must also increase, thereby increasing the size of the whole charger to the point that a compact charger cannot be obtained. Thus, the value of d is desirably set at $d \leqq 10$ mm.

Figure 10:
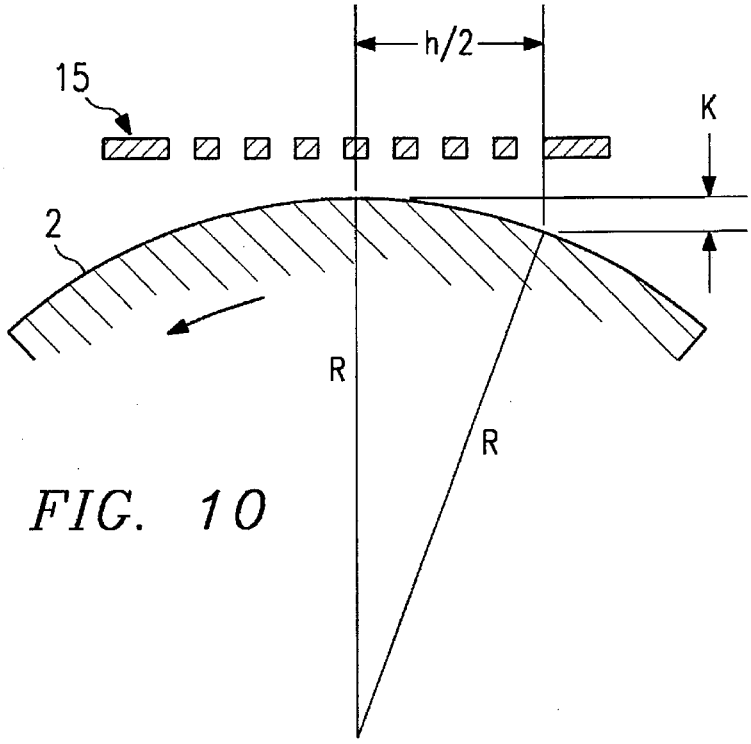
FIG. 10 is a simplified sectional view showing the relationship between the curvature of the photosensitive member and the grid electrode of the charger of FIG. 2.

On the other hand, when the photosensitive member is formed on a cylindrical drum as in the aforesaid embodiment or a belt-like photosensitive member is supported by rollers, the charger is positioned so as to confront the curved portion of the photosensitive member. In such instances, if the grid electrode of the charger is a flat surface, it cannot be disposed along the curvature of the photosensitive member. When the grid electrode of the charger is not disposed along the curvature of the photosensitive member, the center portion of the grid electrode 15 and the end portions thereof are different distances from the surface of photosensitive member 2, as shown in FIG. 10. Therefore, when adjusting the distance of the center portion of the electrode to a suitable distance, the end portions of said grid electrode are not capable of effective charging. At this time, if the difference of the distances from the center portion and the end portions of the grid charger 15 to the photosensitive member 2 is designated k (mm), and the radius of curvature of the photosensitive member 2 is designated R (mm), the following relationship obtains.

$$k = R - \sqrt{R^2 - (h/2)^2}$$

$$\therefore h = 2\sqrt{2kR - k^2}$$

It can be understood from the aforesaid experiments that the surface potential of the photosensitive member 2 drops about 10 V on average for each 0.1 mm increase in the distance between the photosensitive member 2 and the grid electrode 15. This experimental value is the value of the center portion of the grid electrode 15, and the influence of the changes in distance are slight at the end portions which have only slight current distribution.

On the other hand, when the value of k is such that k>2, the majority of the charge current at the ends of the grid electrode 15 flows to the grid electrode 15 itself and is not supplied to the photosensitive member 2. Therefore, in order to effectively utilize the majority of the charge current, the value of k must be such that $k \leqq 2$. Furthermore, when the value of k is such that $k \leqq 1$, the target control potential of the center and end portions approach one another, and the difference is nearly eliminated when $k \leqq 0.5$.

When the optimum value of k is expressed by the set values of h and R, the following expressions obtain.

$$K \leqq 2 : h \leqq 2\sqrt{4R - 4} \qquad \therefore h <= 4\sqrt{R - 1}$$

$$K \leqq 1 : h \leqq 2\sqrt{2R - 1}$$

Accordingly, when the portion of photosensitive member 2 confronting the charger 1 has a curvature of curvature of radius R (mm) in the direction of movement of the photosensitive member 2, the aperture width h of the grid electrode 15 is desirably set at $$h \leqq 4\sqrt{R - 1}$$

and preferably set at $$h \leqq 2\sqrt{2R - 1}$$

and is ideally set at $$h \leqq 2\sqrt{R - 0.25}$$

so as to obtain a charger having a high degree of charging efficiency.

When a discharge electrode is used which has a strong discharge directionality such a projection electrode, the discharge current flows completely in the direction of the grid electrode. Thus, the amount of charge is greatly changed by the aperture efficiency of the grid electrode 15. Charge irregularities occur when dispersion of a grid electrode variable opening ratio increases in a direction perpendicular to the direction of movement of the photosensitive member 2.

Figure 11:
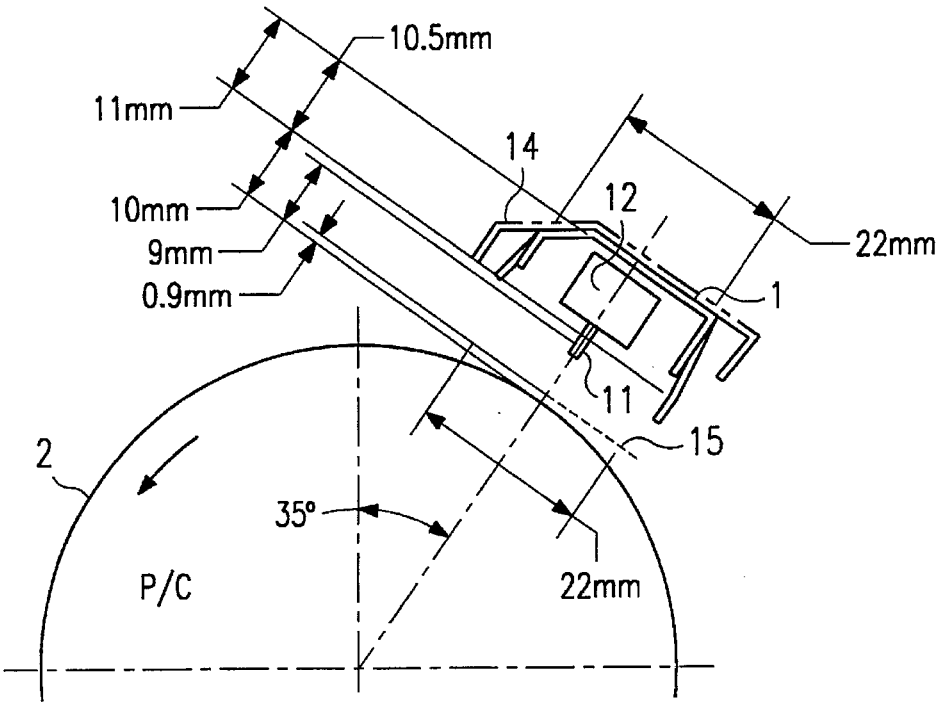
FIG. 11 is a simplified sectional view showing an example of detailed settings of the charger.

In order to solve the aforesaid problem, different, variable opening ratios were used for charger 1 shown in FIG. 2 and experimentally tested. The variable opening ratio was changed by variously changing the grid electrode pattern, wire width, aperture size and the like. FIG. 11 shows the settings of the charger 1 and photosensitive member 2 used in the experiments.

The charger 1 is arranged opposite the photosensitive member 2 at a position 35° on the upstream side in the direction of rotation of the photosensitive member 2. The width of the charger 1 is set at about 22 mm via the stabilizer plate 14 made of stainless steel, and the width of the grid electrode 15 is also set at 22 mm. A stainless steel (SUS304) member having a thickness of 0.05 mm and formed in a sawtooth shape having a tooth angle of 10° and a pitch of 2 mm via compression molding, etching process or the like is used as the discharge electrode 11 of charger 1. The distance between the grid electrode 15 and the photosensitive member 2 was set at 0.9 mm, and the distance between the grid electrode 15 and the discharge electrode 11 was set at 9 mm.

The variable opening ratio a of the grid electrode 15 was designated a (%) in the direction of movement of the photosensitive member 2, and said variable opening ratio a (%) was measured across the entire region in a direction perpendicular to the direction of movement of the photosensitive member 2. The maximum value of the variable opening ratio a (%) measured for each grid electrode 15 was designated $a_{max}$ (%), and the minimum value designated $a_{min}$ solid images were formed by an electrophotographic image forming method using the various grid electrodes. FIG. 12 is a graph showing the relationships among maximum value $a_{max}$ and minimum values $a_{min}$ of the variable opening ratio a (%) of the grid electrodes 15 and the evaluations of the degree of white streaks generated in the solid images obtained in the experiments. The cause of these white streaks is believed to be discharge irregularities generated by dispersion of the variable opening ratio a (%) of the grid electrode 15. Therefore, there were almost no white streaks when $(a_{max}-a_{min})/(a_{max}+a_{min})<0.25$, and absolutely no white streaks when $(a_{max}-a_{min})/(a_{max}+a_{min})<0.20$. In identical experiments using halftones, the absence of white streaks was confirmed when the values were within the aforesaid range. Therefore, the condition states that uniform charging of the charge-receiving member can be accomplished and excellent images without white streaks can be obtained by using a grid electrode having a variable opening ratio dispersion of grid electrode 15 in the lengthwise direction desirably within a range $$(a_{max}-a_{min})/(a_{max}+a_{min})<0.25$$

and preferably within a range $$(a_{max}-a_{min})/(a_{max}+a_{min})<0.20.$$

When a charger is used which satisfies all the previously mentioned setting values, the objects of the present invention are achieved by providing a compact charger which suppresses charge irregularities and image drift, produces very little ozone and NOx, and has high charging ability.

The present invention is particularly effective when a charge electrode is used which has a high directionality such as a projection electrode.

FIGS. 13*a*, 13*b*, and 13*c* are enlarged perspective views showing examples of other configurations of the tips 11*a* of the projection electrode used in the present invention. Each tip 11*a* of the discharge electrode 11 may be a cuboidal tip having a peaked shape as shown in FIG. 13*a*, a cylindrical shape of a wire or needle as shown in FIG. 13*b*, or a cylindrical member having a sharp needle-like tip as shown in FIG. 13*c*.

Figure 15:
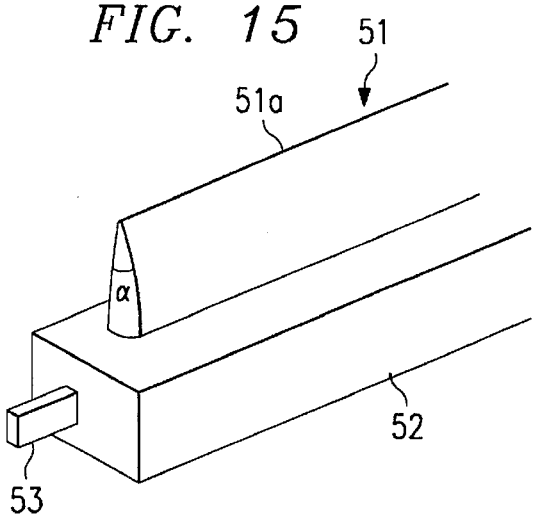
FIG. 15 is a partial perspective view showing another example of the discharge electrode of the charger.

FIGS. 14 and 15 show examples of other configurations of the discharge electrode 11 and the discharge electrode holder 12. FIG. 14 provides a needle-like discharge electrode 41 instead of sawtooth shaped the discharge electrode 11. When the discharge electrode 41 is used, the discharge point intersects the needle shaped tips 41*a*, such that directionality is improved and ozone generation can be suppressed.

FIG. 15 shows an example using a wedge-shaped discharge electrode 51. The discharge electrode 51 of FIG. 15 is configured such that the entire wedge-shaped tip 51*a* is a discharge point and provides uniform charge in the lengthwise direction compared to the needle shape of FIG. 14 or the sawtooth shape of FIGS. 3 and 4. Directionality is extremely high compared to wire electrodes. The more acute the angle $\alpha$ of wedge-shaped tip 51*a*, the higher the directionality and lower the ozone generation.

These discharge electrodes have stronger directionality than the wire electrodes used in corona chargers. In the case of scorotron charger having a grid electrode in particular, stable charging is realized even without a stabilizer, since the grid electrode acts as a stabilizer.

The discharge electrodes 41 and 51 of FIGS. 14 and 15 may be embedded in the discharge electrode holders 42 and 52. Such constructions restrict the discharge point to the electrode tip area and suppress zone generation. In order to simplify the manufacturing process, discharge electrodes 41 and 51 may be gripped by a discharge electrode holder, as in the embodiment shown in FIG. 1. A charging bias is supplied by discharge electrode pins 43 and 53.

Figure 16:
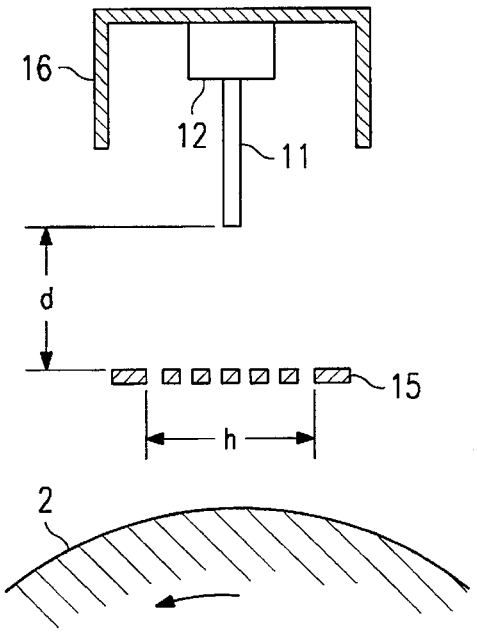
FIG. 16 a simplified sectional view showing another example of the discharging device of the charger.
Figure 17:
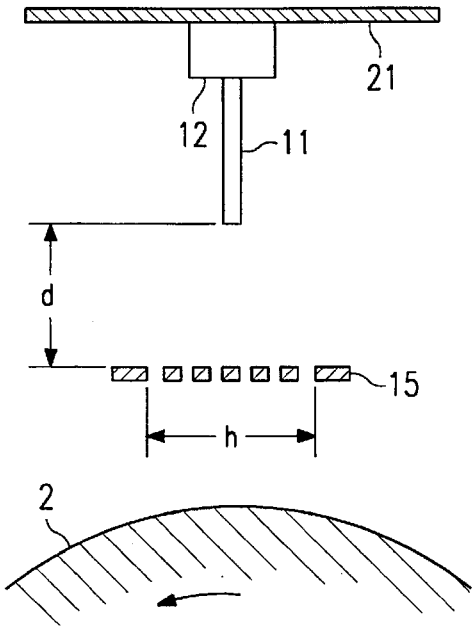
FIG. 17 is a simplified sectional view showing another example of a charger.
Figure 18:
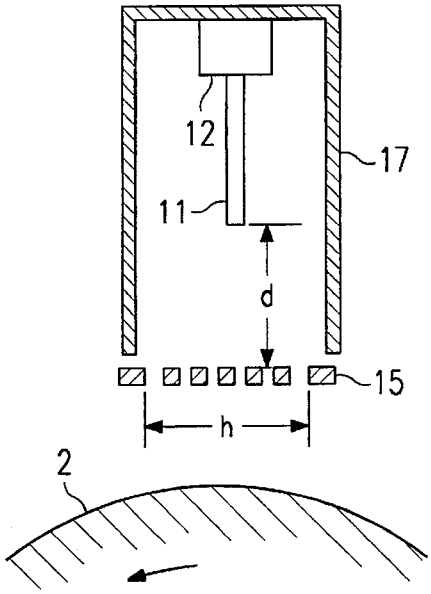
FIG. 18 is a simplified sectional view of another example of a charger.

FIGS. 16~18 are simplified sectional views showing other configurations of the charger of the present invention. The configuration of FIG. 16 provides that the tip 11*a* of the discharge electrode 11 extends beyond the portion circumscribed by a stabilizer plate 16. The charge flow toward the stabilizer plate 16 is suppressed because the stabilizer plate 16 is offset from the discharge direction (downward in the drawing) of the discharge point 11*a* by extending the tip 11*a* of the discharge electrode 11 from the portion circumscribed by the stabilizer plate 16. Therefore, the current inflow to the stabilizer plate 16 from the discharge electrode 11 is suppressed so as to be extremely low, thereby improving charging efficiency. Furthermore, adequate stability is assured by the action of the grid electrode 15 alone because the discharge electrode 11 has a discharge directionality greatly higher than a wire electrode.

FIG. 17 shows a discharge electrode mounting plate 21 instead of the stabilizer plate 14. The discharge electrode mounting plate 21 does not have any part opposite the side surfaces of the discharge electrode 11. Thus, the influx current inflow toward the electrode mounting plate 21 is eliminated. Discharge efficiency is therefore extremely high because the discharge occurs only in the direction of the photosensitive member 2 via the action of the discharge electrode 11 and the grid electrode 15.

FIG. 18 shows an example using an insulated stabilizer plate 17 formed of an insulated member. Since current does not flow to the insulated stabilizer plate 17, the current distribution has a high directionality in the direction of the grid electrode 15, thereby improving charging efficiency. Current leaks are reduced because the discharge electrode 11 is substantially enclosed by the insulated stabilizer plate 17, and can be handled in safety As shown in FIGS. 16 and 17, the edge of the plate is set above the discharge point, such that all the discharge current flows to the grid electrode 15; directionality is markedly improved by covering the vicinity of the discharge electrode 11 with the insulated stabilizer plate 17 as shown in FIG. 18. Even greater effectiveness is achieved when the present invention is used in a charger with improved directionality.

The present invention may be adapted to chargers having weak directionality such as chargers using wire electrodes to obtain a certain degree of effectiveness.

FIGS. 19~23 show other examples of grid electrode pore patterns for the grid electrode 15.

Figure 19:
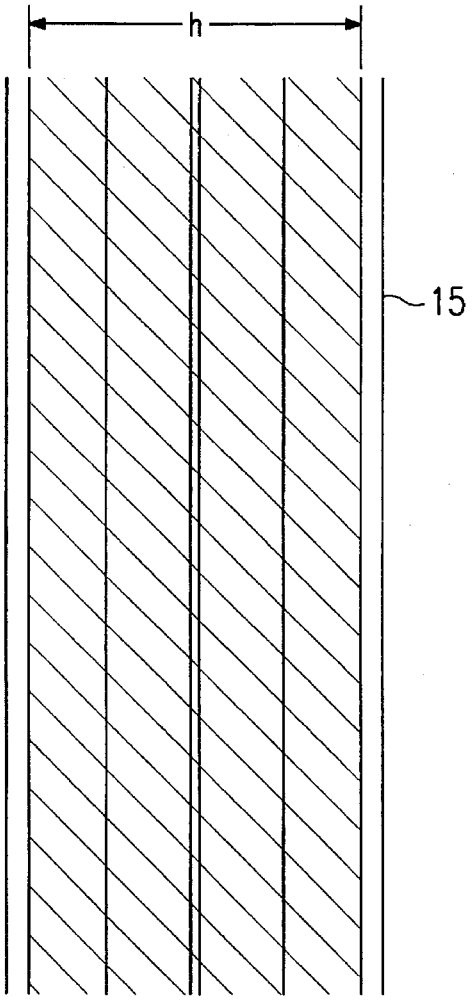
FIG. 19 shows another example of a grid electrode pattern of a charger.

The grid electrode pore pattern of FIG. 19 is formed by a stainless steel plate, a copper plate, a steel plate or the like having a thickness in the range of 0.05~2 mm via an etching process or pressing process. This pattern is a complex pattern formed by some fine grid electrode wires, and is suitably for an etching process. The etching process is suitable for complex patterns inasmuch as very fine grid electrode wires can be formed compared to press processes. When grid electrode wires are made fine, charging efficiency is improved. Charges of even greater homogeneity can be attained using the pattern of FIG. 19.

Figure 20:
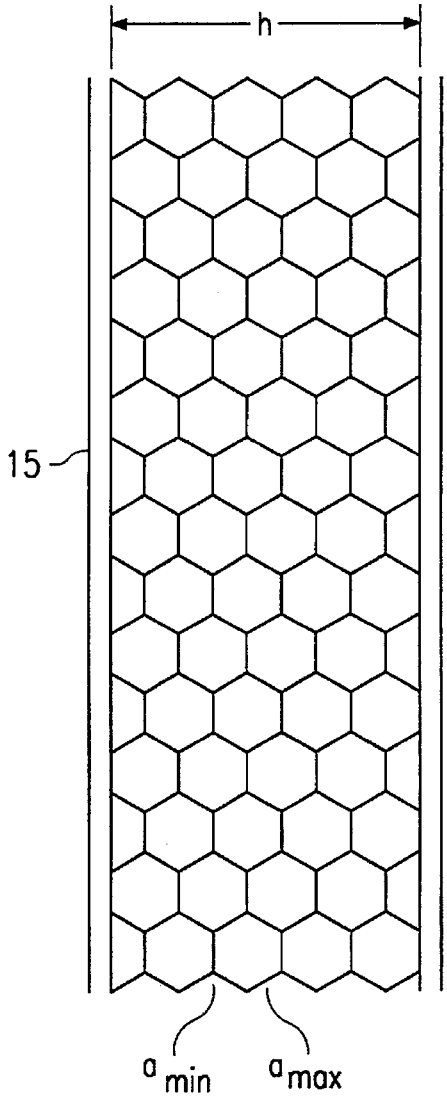
FIG. 20 shows another example of a grid electrode pattern of a charger.

FIG. 20 shows a combination of hexagonal grid pores formed in a honeycomb pattern. This pattern uniformly distributes the grid aperture throughout the entire grid electrode.

Figure 22:
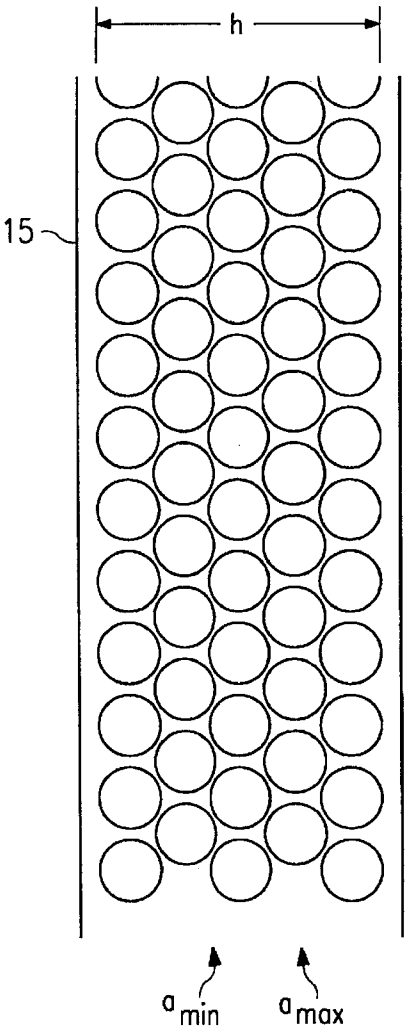
FIG. 22 shows another example of a grid electrode pattern of a charger.
Figure 21:
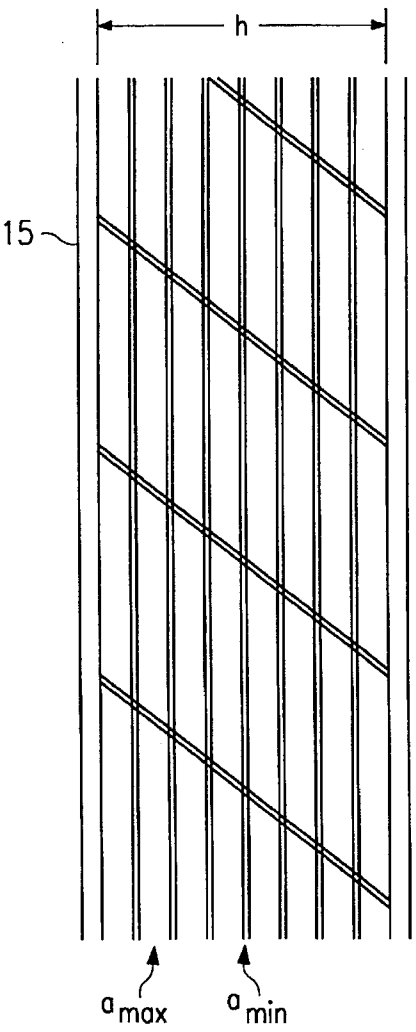
FIG. 21 shows another example of a grid electrode pattern of a charger.

FIGS. 21 and 22 show patterns suitable for press processes. These patterns are simple, and provide thick grid electrode wires. Press processes are less costly and labor intensive than the etching processes. The grid electrode pore pattern is not limited to the aforesaid patterns inasmuch as a suitable pattern may be selected which satisfies the various conditions and limitations of use and processing.

Figure 23:
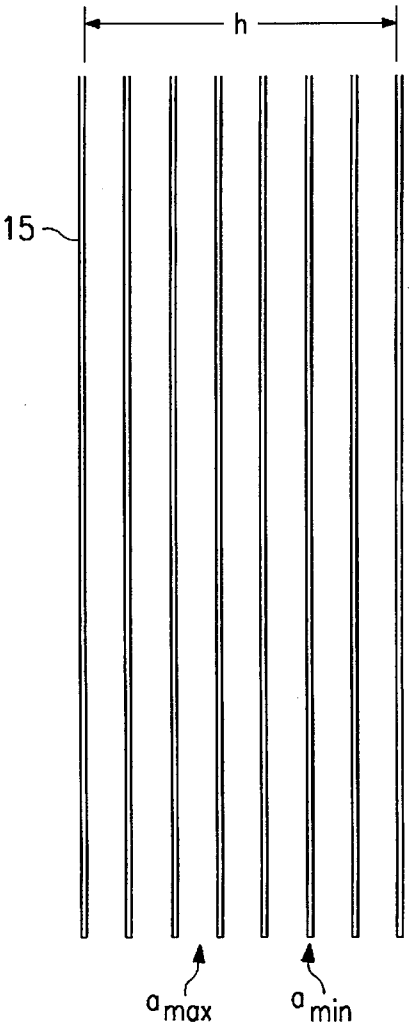
FIG. 23 shows another example of a grid electrode pattern of a charger.

FIG. 23 shows an example which used tungsten wires or molybdenum wires having a diameter in the range of about 20~500 μm, or said wires covered with gold or platinum. When wires are used, finer grid electrode wires can be obtained than plates subjected to press processing, thereby improving charging efficiency.

In the present invention, a typical photosensitive member may be used in the electrophotographic image forming apparatus as the charge-receiving member suitable for maximum efficiency of the present invention. The charger of the present invention may be used, in addition to charging a photosensitive member, for transfer, discharging and other uses with other charge-receiving members other than photosensitive members. Charge-receiving members other than photosensitive members include dielectric member and semiconductors used with intermediate transfer members and transport belts, and magnetic members used in magnetic type copying methods.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed:

1. An image forming apparatus, comprising:

an electrostatic latent image carrier which includes an image forming layer on a conductive base; and a charging device which includes an electric discharge electrode having a plurality of projections opposing a surface of said electrostatic latent image carrier, a grid electrode located between said electric discharge electrode and said surface of said electrostatic latent image carrier, wherein a grid electrode electric current Ig passing through said grid electrode and an image carrier electric current Ip passing through said conductive base of said electrostatic latent image carrier satisfy the following relationship:

$$1.5 \leqq Ig/Ip \leqq 4.$$

2. An image forming apparatus as claimed in claim 1, further comprising:

a stabilizing plate opposing said electrostatic latent image carrier so as to partially encircle said electric discharge electrode, said stabilizing plate including a conductive member.

3. An image forming apparatus as claimed in claim 2, wherein said grid electrode electric current Ig passing through said grid electrode, said image carrier electric current Ip passing through said conductive base of said electrostatic latent image carrier, and a stabilizing plate electric current Ish passing through said stabilizing plate satisfy the following relationship:

$$1 \leqq (Ig/Ip)/Ish.$$

4. An image forming apparatus as claimed in claim 1, wherein said grid electrode includes a plurality of grid wires.

5. An image forming apparatus as claimed in claim 4, wherein said plurality of projections have a pitch P, wherein said grid wires have a width L and are arranged with a grid wire spacing D, and wherein said pitch P, said width L, and said spacing D satisfy the following relationship:

$$P/(D+L)=n$$

where n is an integral number.

6. An image forming apparatus as claimed in claim 4, wherein said plurality of projections have a pitch P, wherein said grid wires have a width L and are arranged with a grid wire spacing D, and wherein said width L and said spacing D satisfy the following relationship:

$$n+0.9 \leqq P/(D+L) \leqq n+1.1$$

where n is an integral number.

7. A charging device for charging a surface of an image carrier, comprising:

an electric discharge electrode positionable in opposition to said surface of said image carrier for discharging said surface at a discharging point; and a grid electrode having an effective width h and confronting said discharging point of said electric discharge electrode at a fixed distance d, wherein said effective width h and said distance d satisfy the following relationship:

$$1 \leqq h/d \leqq 1.5.$$

8. A charging device as claimed in claim 7, wherein said electric discharge electrode has a plurality of projections positionable in opposition to said surface of said image carrier.

9. A charging device as claimed in claim 7 wherein said distance d is not more than 10 mm.

10. An image forming apparatus comprising:

an image carrier having a surface with a radius of curvature R;

a charging device for charging said surface of said image carrier;

an electric discharge electrode for discharging said surface of said image carrier at a discharging point; and a grid electrode having an effective width h and being located between said electric discharge electrode and said surface of said image carrier;

wherein said effective width h and said radius of curvature R satisfy the following relationship:

$$h \leqq 4\sqrt{R-1}\ .$$

11. An image forming apparatus as claimed in claim 10, wherein said electric discharge electrode has a plurality of projections positioned in opposition to said surface of said image carrier.

12. An image forming apparatus as claimed in claim 10, wherein said effective width h and said radius of curvature R satisfy the following relationship:

$$h \leqq 2\sqrt{2R-1}\ .$$

13. An image forming apparatus as claimed in claim 10, wherein said effective width h and said radius of curvature R satisfy the following relationship:

$$h \leqq 2\sqrt{R-0.25}\ .$$

14. A charging device for charging a surface of a movable image carrier, comprising:

an electric discharge electrode for discharging at a discharging point; and a grid electrode positioned to be between said image carrier and said electric discharge electrode, said grid electrode being provided with an opening having a variable opening ratio a;

wherein a maximum value $a_{max}$ of said variable opening ratio a and a minimum value $a_{min}$ of said variable opening ratio a satisfy the following relationship:

$$(a_{max}-a_{min})/(a_{max}+a_{min})<0.25.$$

15. A charging device as claimed in claim 14, wherein said electric discharge electrode has a plurality of projections for opposing said surface of said image carrier.

16. A charging device as claimed in claim 14, wherein said maximum value $a_{max}$ and said minimum value $a_{min}$ satisfy the following relationship:

$$(a_{max}-a_{min})/(a_{max}+a_{min})<0.20.$$

* * * * *

UNITED STATES PATENT AND TRADEMARK OFFICE

CERTIFICATE OF CORRECTION

PATENT NO. : 5,666,604

DATED : September 9, 1997

INVENTOR(S) : Nakagami et al

It is certified that error appears in the above-indentified patent and that said Letters Patent is hereby corrected as shown below: Title page, Item [54] and column 1, line 3, delete "ZIP" and insert --TIP--.

Signed and Sealed this

Ninth Day of June, 1998

*Attest:*

*Attesting Officer*

BRUCE LEHMAN

*Commissioner of Patents and Trademarks*